United States Patent [19]

Raker et al.

[11] Patent Number: 5,031,889

[45] Date of Patent: Jul. 16, 1991

[54] FOLDER AND FEEDER APPARATUS

[75] Inventors: John W. Raker, Cleveland; Keith S. Macey, Rocky River; Victor A. Zugel, Parma, all of Ohio

[73] Assignee: K. S. Macey Machine Company, Inc., Cleveland, Ohio

[21] Appl. No.: 339,810

[22] Filed: Apr. 18, 1989

[51] Int. Cl.[5] ..... B42C 1/00

[52] U.S. Cl. ..... 270/45; 271/31.1; 493/423; 493/441

[58] Field of Search ..... 270/32, 45, 54; 271/11, 271/12, 90, 30.1, 31.1; 493/405, 416, 423, 436, 441

[56] References Cited

U.S. PATENT DOCUMENTS

| | | | |
|---|---|---|---|
| 3,438,622 | 4/1969 | Laschewski | 270/45 |
| 4,588,180 | 5/1986 | Balleshazzi | 271/31.1 |
| 4,747,817 | 5/1988 | Newsome | 270/55 |
| 4,822,234 | 4/1989 | Johnson | 271/31.1 |
| 4,867,432 | 9/1989 | Matta | 271/31.1 |

*Primary Examiner*—Edward K. Look

*Assistant Examiner*—Therese M. Newholm

*Attorney, Agent, or Firm*—Fay, Sharpe, Beall, Fagan, Minnich & McKee

[57] ABSTRACT

A feeder-folder unit for use in folding paper sheet stock and delivering it to a signature gathering machine comprises a main frame with a hopper assembly carried by the main frame for receiving and storing a supply of sheets of paper stock. A sheet extractor and transfer drum assembly is located adjacent the hopper for extracting individual sheets of paper stock from the hopper means and conveying the extracted sheets along a path to a scoring and folding unit located adjacent the path. The hopper assembly includes a pair of spaced support surfaces for supporting the sheets of stock and intermittently actuated drive chains are provided for driving the sheets along the support surfaces toward the sheet extractor and transfer drum assembly. Each of the support surfaces is adjustable independently of the other and the drive chains to selectively vary the presentation of the sheets to said sheet exterior and transfer drum assembly to thereby permit precise positioning of the sheets relative to the scoring and folding unit.

9 Claims, 4 Drawing Sheets

FOLDER AND FEEDER APPARATUS

BACKGROUND OF THE INVENTION

The subject invention is directed toward the art of signature gathering machines and, more particularly, to a feeder-folder unit for feeding individual sheets or signatures from a supply hopper through a folding unit. The unit is particularly suited for handling and precision folding cover stock and will be described with particular reference thereto; however, it should be appreciated that that a unit of the type under consideration is capable of handling and folding a variety of types of sheet material for many uses.

As can be appreciated, when feeding and folding relatively stiff and rigid cover stock, it is desirable to maintain the folds at a precision location on the stock so that the mating edges of the folded cover match with great precision. Additionally, it is highly desirable that the fold be relatively crisp and smooth with no damages to the sheet stock adjacent the fold.

The above noted needs and goals for an apparatus of this type is met by the subject invention which provides an extremely effective and efficient feeder folder apparatus wherein the supply hopper is provided with means which permit extremely fine and delicate adjustments to be made in the location of the feed stock relative to the feeder scoring and folding units. Additionally, the folding unit is designed such that the fold is made very effectively with a minimum of disturbance or damage to the stock adjacent the fold line.

BRIEF STATEMENT OF THE INVENTION

In particular, and in accordance with the subject invention, there is provided a feeder-folder unit for use in folding paper sheet stock and delivering it to a signature gathering saddle which comprises a main frame and a hopper means carried by the main frame for receiving and storing a supply of sheets of paper stock with the individual sheets of paper stock positioned in aligned, vertical side-by-side relationship. A sheet extractor and transfer drum unit is located adjacent the hopper means for extracting individual sheets of paper stock from the hopper means and conveying the extracted sheets along a first path. Located along the first path are scoring and folding means for receiving the sheets conveyed therealong. To properly present the sheets to the sheet extractor for delivery to the scoring and folding means, the hopper is provided with adjustment means which include at least a pair of spaced support surfaces for supporting and orienting the supply of sheet stock at least during the period immediately prior to sheet extraction. Intermittently actuated means are provided for driving the sheets along the support surfaces toward the sheet extractor and transfer drum means. Most importantly, there are adjustment means for allowing variations in the positioning of the support surfaces independently of each other to selectively vary the presentation of the sheets to the sheet extractor and transfer drum means. Preferably, the intermittently actuated means comprise a pair of continuous chain type drive means which are located adjacent the support surfaces and are supported independently of the support surfaces.

Preferably, the support surfaces are pivotally connected to the support frame for the intermittently actuated means.

In accordance with another aspect of the invention, a feeder-folder apparatus of the general type described includes folding means located along the path of movement of the sheet stock and which receives the sheet stock from the scoring roll means to fold it into a generally V-shaped configuration. The folding means comprises first and second endless belts of circular cross-section mounted on a first side of the path in closely spaced relationship thereto. A third endless belt means is mounted on an opposed side of the path opposite the first and second belts. The third endless belt means has an outwardly facing V-shape and is positioned to extend between the first and second belts such that sheet stock passing along the path is folded over the third endless belt by the first and second endless belts.

In accordance with a more limited aspect of the invention, the endless belts are simultaneously driven in the same direction at correspondingly equal speeds and a pair of pinch rolls is positioned adjacent the path and adapted to receive the sheet stock exiting from the folding means to apply a more complete bend to the stock.

As is apparent from the foregoing, a primary object of the invention is the provision of a feeder folder apparatus wherein the positioning of the sheet stock being fed to the folder unit can be closely controlled and adjusted to result in precision presentation of the stock to the folder unit.

A further object of the invention is the provision of a feeder-folder apparatus wherein the stock supply means has sheet support surfaces which are related to sheet drive means in a manner which allows close adjustment and control of the engagement of the drive means with the sheet stock.

A still further object is the provision of a folder unit for use with a signature gathering machine wherein the folder unit accomplishes a folding operation through the use of continuous belts which engage the sheet stock on opposite sides and which do not cause damage to the stock during the folding operation.

A still further object of the invention is the provision of an apparatus of the general type described which is simple and effective if in operation.

The above and other objects and advantages will become apparent from the following description when read in conjunction with the accompanying drawings wherein.

Figure 1:
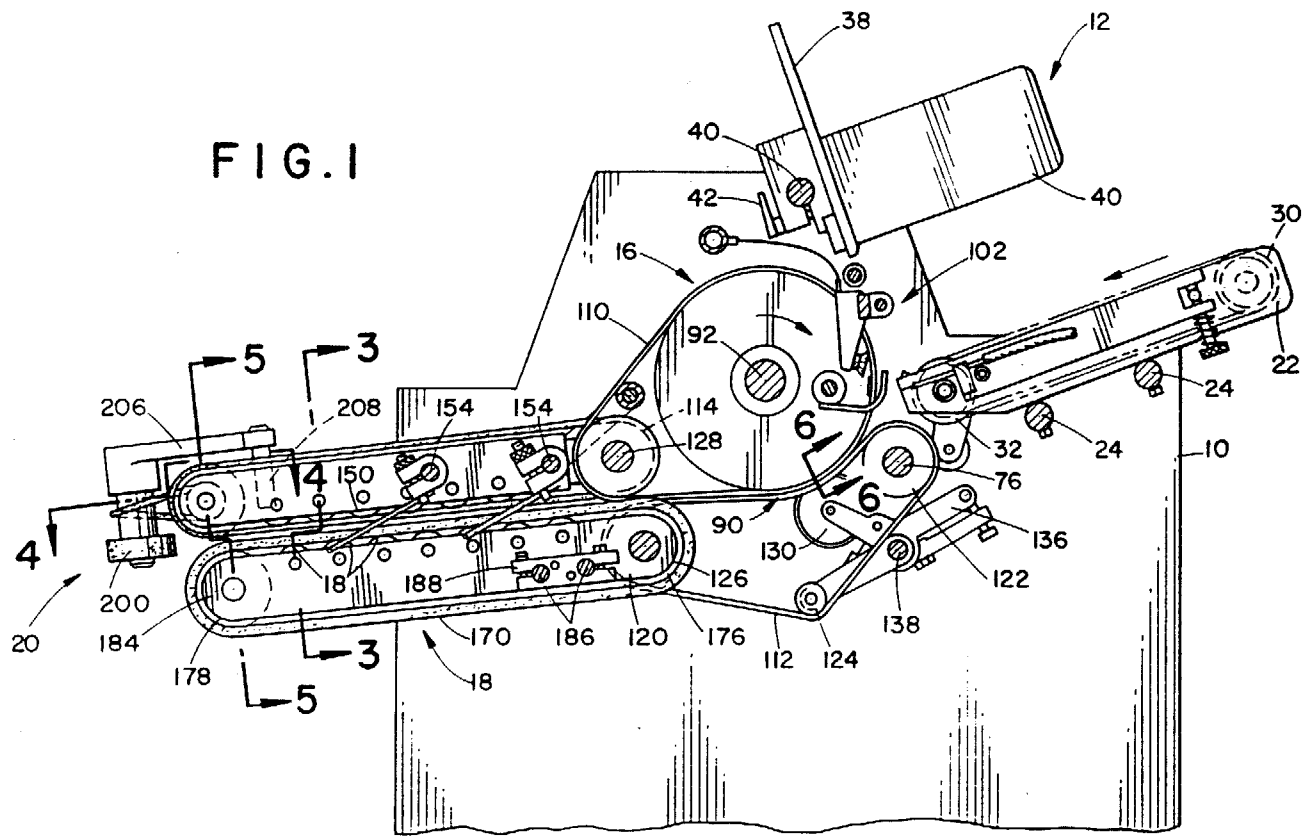
FIG. 1 is a side elevation, somewhat diagrammatic, showing the overall relationship of the major components of the feeder folder unit.
Figure 2:
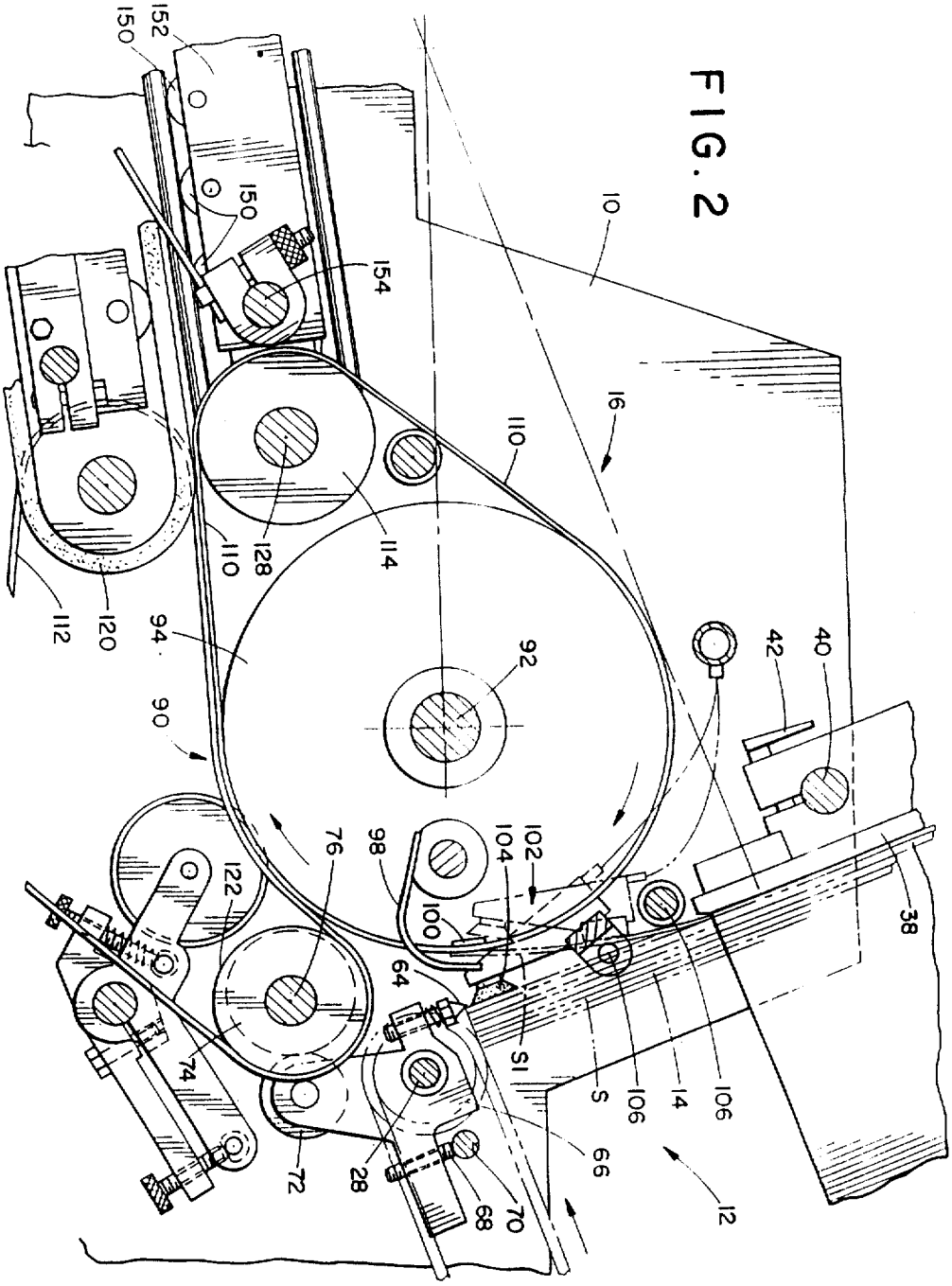
FIG. 2 is a greatly enlarged side elevation view showing the relationship between the hopper assembly and the sheet extractor and transfer drum assembly.

Referring more particularly to the drawings wherein the showings are for the purpose of illustrating a preferred embodiment of the invention only and not for the purpose of limiting same, FIGS. 1 and 2 best illustrate the overall structural and functional relationship between the various components of the subject feeder folder assembly. Broadly, the assembly generally includes a main frame 10 which generally comprises spaced side plates and suitable support structure for carrying a supply hopper assembly 12 which is designed and arranged for holding and storing a supply of individual sheets of paper stock S with the individual sheets positioned in generally vertical side-by-side relationship as broadly illustrated in FIG. 2.

Associated with the supply hopper assembly 12 is a sheet extractor and transfer drum means 16 which is located closely adjacent the hopper assembly 12 and is provided with suitable apparatus, as will subsequently be described, for extracting individual sheets of paper stock from the hopper assembly and conveying the extracted sheets along a path to the folder assembly 18 which is located immediately downstream of the extractor and transfer drum assembly 16. The folder assembly 18 is designed and arranged such that the sheets conveyed therethrough are caused to be precision folded along a predetermined line and conveyed through a pinch roll assembly 20 wherein the final crease or fold is applied to the sheets after which they are deposited on a conventional signature gathering chain assembly passing thereunder but not shown in the subject drawings.

Referring more specifically to FIG. 1, 2, 7 and 8, the overall arrangement of the supply hopper assembly 12 can be best understood. Broadly, as more particularly illustrated in FIGS. 7 and 8, the assembly 12 includes a first pair of spaced side frame members 22 which are mounted in parallel relationship between the side walls of the main frame 10 by a pair of generally horizontally extending support members 24. Carried between the side frame members 22 are a pair of rotatably mounted shafts 26, 28, each carrying respective pairs of sprockets 30, 32. The aligned sets of the sprockets have conventional chains 34, 36 trained thereabout. The chains (see FIG. 8) have their upper runs at the same elevation for engagement with the bottom edges of the sheet material stock carried in the hopper assembly. The chains 34, 36 are suitably indexed or driven by conventional apparatus not shown to move in the direction of the arrow and maintain the stack or supply of paper sheet stock continually moved to the left.

As best shown in FIGS. 1 and 2, the leftward movement of the sheet stock is limited by a hopper wall member 38 carried from a horizontally extending shaft 40 supported by the side plates of the main frame 10. The plate 38 is adjustable on shaft 40 through the use of a clamp plate mount assembly 41 controlled by a screw and handle member 42. Additionally, an end plate 44 is connected to the wall member 38 and extends rearwardly therefrom to generally position the supply of sheet stock transversely of the hopper assembly 12

Figures 7, 8:
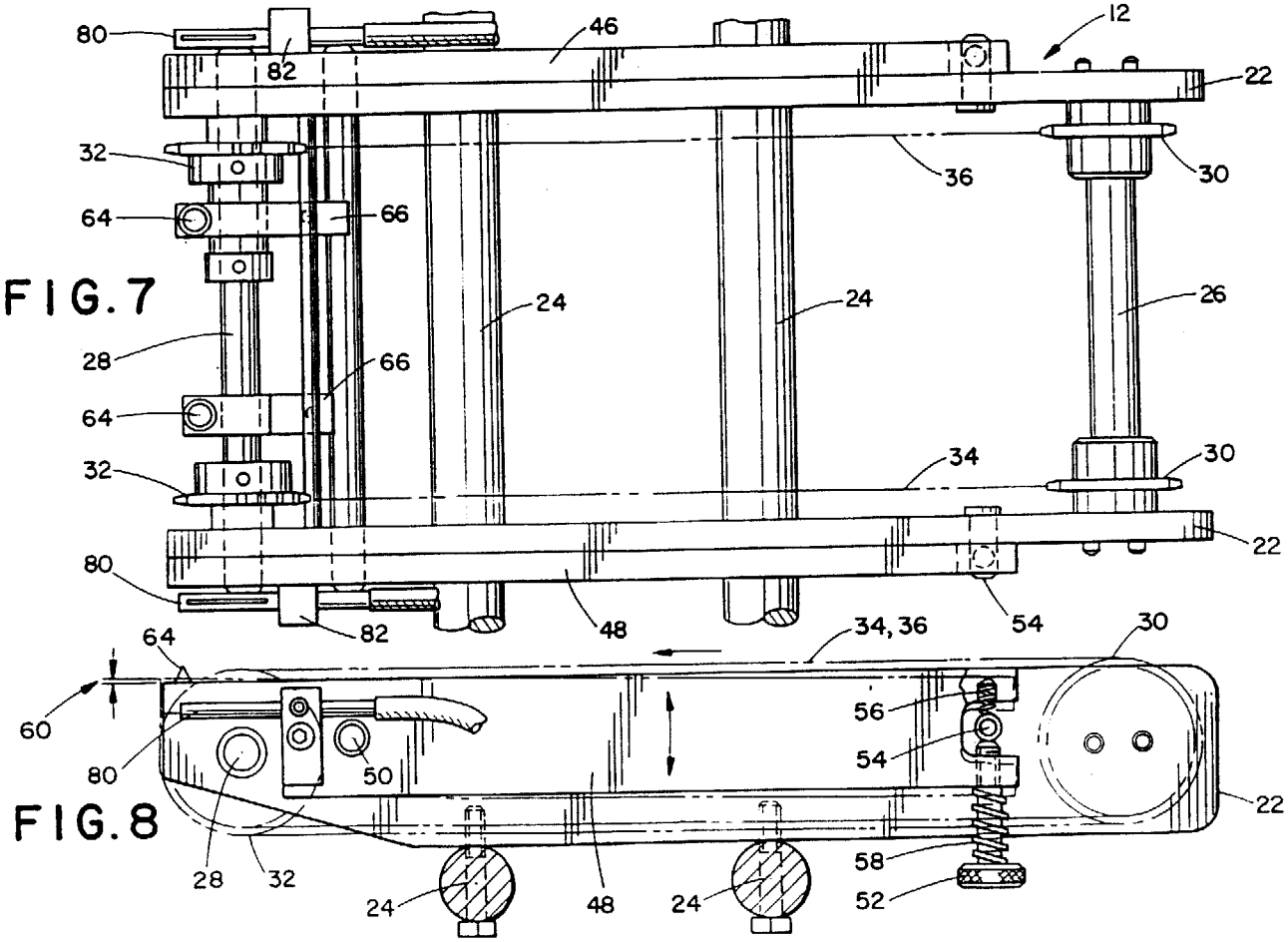
FIG. 7 is a top view of the hopper assembly.
FIG. 8 is a side view of the hopper assembly.

Referring again to FIGS. 7 and 8 the arrangement used for fine adjustment of the positioning of the sheet stock will now be described. As illustrated in FIGS. 7 and 8, a pair of plate members 46 and 48 are carried at the outer sides of the side frame members 22. In particular, each of the plates 46, 48 is mounted for pivotal adjusting movement about the transversely extending shaft 50. More particularly of the side members 46, 48 is arranged so as to be independently adjustable about the axis of shaft 50. The adjustments could be made in a variety of ways, however, in the subject embodiment, the right hand end of each of the side plates 46, 48 (as viewed in FIG. 7) is bifurcated as shown and suitable pin or stud members 54 extend outwardly from the plates 22 between the bifurcations. Thumb screws 52 are threadedly received through the lower bifurcation and engage on the underside of the respective stud 54. A spring 56 mounted in the upper bifurcation as shown acts against the upper side of the respective stud 54 to maintain engagement between the stud 54 and the end of the thumb screw 52. Similarly, a coil spring 58 is located about the thumb screw 52 to take up lost motion and prevent undesired rotation of the screw 52.

As can be appreciated, by adjustment of the respective screws 52 each of the members 46, 48 can be adjusted about the axis 50 to vary the inclination of their upper surfaces a slight amount as shown at 60 in FIG. 8. More particularly, the upper surface of each of the members 46, constitutes a support surface for the paper sheet stock when it is in its final left hand position immediately prior to being removed by the extractor drum assembly. That is, as shown in FIGS. 2 and 8, the final few pieces of sheet stock are totally supported independent of the chains by the upper surfaces of the members 46, 48. Thus, by independently adjusting the two members 46, 48 the horizontal tilt or positioning of the sheet stock can be given extremely fine adjustment to assure that when it is engaged by the extractor drum it has a precise position so that the ultimate fold line is located with precision at the position desired.

To assist in maintaining the sheets at their final desired location a pair of stop fingers 64 are carried on suitable brackets as shown. One of the stop fingers is mounted for oscillation on a bracket 66. The bracket 66 is pivotally mounted from the previously mentioned shaft 28 and includes an adjustable screw 68 which is threadedly received through an arm on the member 66 and engages the underside of a transverse shaft 70 to bias the member 66 in a clockwise direction. Similarly, the movable stop pin 64 is adjustably carried in arm 66 and each includes a coil spring thereabouts to prevent undesired adjustment. As will subsequently become apparent, the movement of the movable member 64 is coordinated with the operation of the extraction drum assembly 16 so that the stop member is moved out of blocking position when a sheet is to be extracted from the supply hopper 12. For this purpose, the member 66 carries a cam follower roller 72 which engages with a cam element or eccentric 74 carried from a rotatably driven shaft 76. During rotation of the shaft 76 member 66 is oscillated to move the movable stop member 64 from the stop position to a spaced sheet releasing position.

Also associated with the supply hopper 12 are suitable air outlet nozzle members 80 located at each side of the members 46, 48 (see FIG. 7) and carried from brackets 82 mounted on the outer surfaces of members 46 and 48 as shown. Each of the nozzles 80 includes an upwardly facing elongated slot 84 which is arranged to direct a thin high velocity air jet against the underside of the leading sheets in the stack of paper sheets carried in the supply hopper. This air jet functions to assist in separating the sheets to facilitate sheet extraction by the extractor drum assembly 16.

Figure 6:
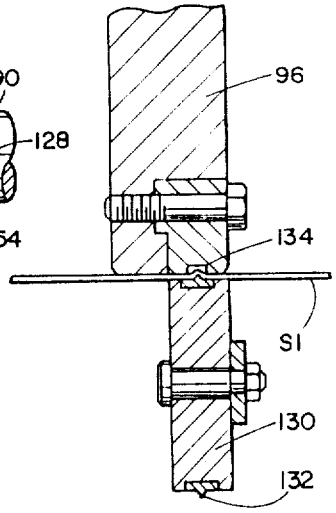
FIG. 6 is a cross-sectional view taken along line 6–6 of FIG. 1.

Referring again to FIGS. 1 and 2 the overall arrangement of the extractor drum assembly 16 can be understood. In particular, the extractor drum assembly 16 comprises a drum assembly 90 which comprises three disc members mounted on a horizontally extending driven shaft 92. A pair of outer disc members 94 are located on opposite sides of a center disc 96. Disc 96 is generally illustrated in FIG. 6. Referring again to discs 94, these discs are spaced apart a distance slightly less than the minimum width of sheet material to be carried in the supply hopper 12. Additionally, each of the discs 96 carries a suitable gripper finger 98 of conventional construction which is oscillated to move counterclockwise during clockwise rotation of drum 90 and clamp against a suitable clamp surface 100 carried on the outer surface of each of the two spaced drums 94. Also associated with the end of the storage or supply hopper assembly 12 are a pair of conventional oscillated vacuum cup assemblies 102 each having a vacuum cup member 104 which is adapted to be moved from the solid line to the dotted line position shown in FIG. 2. More particularly, each assembly 102 is mounted for pivotal movement about shaft 106 in timed relationship with the rotation of the drum assembly 90. In particular, the vacuum cup assembly 102 is moved to the solid line position and actuated to engage the outermost sheet member and thereafter is oscillated in a counterclockwise direction pulling the sheet member laterally away from the remaining sheets in the hopper assembly.

When pulled to its leftmost position as viewed in FIG. 2, the sheet $S_1$ is engaged by the clamp finger 98 and pulled from the hopper assembly along a path of movement defined by the exterior of the extraction drum members 94 and 96. The movement of the sheet from the hopper assembly is guided and controlled by a horizontally extending roller 106 located as illustrated and mounted between the side walls of the main frame 10.

The path of movement of the sheet $S_1$ as it is extracted from the opera assembly by the extraction drum 94 is defined by cooperating pairs of endless guide belts 110 and 112 which are carried in opposed pairs in the plane of the spaced drums 94. In particular, each of the laterally spaced belts 110 are trained about a respective one of the drum member 94 and a correspondingly positioned drum or pulley member 114.

The correspondingly located endless belts 112 are similarly trained about a pair of spaced guide rollers or drums 120 and 122 and a tension roller 124. As best seen in FIG. 2 roller 122 is mounted on shaft 176 and roller 120 and upper roller 114 are mounted on a pair of parallel shafts 126 and 128 respectively.

As can be seen, the upper run of each of the two spaced belts 112 and the lower run of the two spaced upper belts 110 are in engagement and defined the path of movement of the sheets being moved by the extractor drum assembly. During movement along the path so defined, the individual sheets are scored by a scoring drum member 130 best shown in FIG. 6. As illustrated therein, drum 130 cooperates with the center drum 96 of the drum assembly 16. To produce the required score, the drum 130 includes an outwardly extending scoring ridge 132 which is in alignment with a resilient insert 134 carried in the exterior of the drum 96. As the drum 96 and the scoring drum 132 rotate a transverse score is place therein because of the cooperation between ridge 132 and the section 134.

The scoring drum could be mounted in many different ways to perform its function. In the subject embodiment, however, it is carried by a lever assembly 136 carried from a horizontally extending shaft or rod 138. Suitable tensioning and support members, not shown, are provided for varying the forces acting to move the wheel 130 into contact with drum 96. Similarly, the pulley 124 is also mounted from shaft 138 and is likewise provided with means not shown for varying the force it applies to the belt 112.

After passing through the extractor and conveyor assembly 16 the individual sheets $S_1$ are received by the folder assembly 18. Referring to FIGS. 1 and 3 through 5 it will be seen that the folder assembly 18 includes a first pair of spaced pulleys 148 which are carried on the previously mentioned shaft 128 in general alignment with the scoring drum 130. That is, the pulleys 148 are positioned to be aligned with the scoring drum or member 130 so that each pulley 148 is equally spaced on opposite sides of member 130 but in a plane parallel thereto. Also aligned with pulleys 148 are a series of individual small diameter pulleys 150 best seen in FIGS. 1 and 2. The pulleys 150 are carried between a pair of spaced frame or side plates 150. As can be seen, the plates 152 are carried by horizontally extending shafts 154 which are supported from the side frames of the main frame 10. The frame or plate members 52 can be adjusted to bring the pulleys into alignment with the scoring drum 130 by suitable collar members 156 which are adjustable on the shafts 154.

Trained about the pulleys 148 and 150 are a pair of endless belts 158 which have a generally circular cross-section and are formed from a hard but somewhat resilient material. As will be explained in more detail subsequently, the belts 158 cooperate to apply a downward bending force to sheet $S_1$ on each side of the score produced by drum 130.

Figure 3:
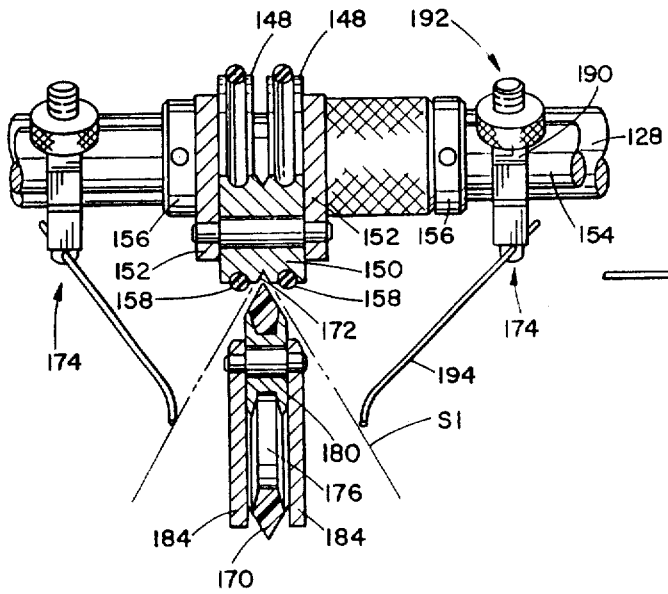
FIG. 3 is a cross-sectional view taken on line 3–3 of FIG. 1.
Figure 5:
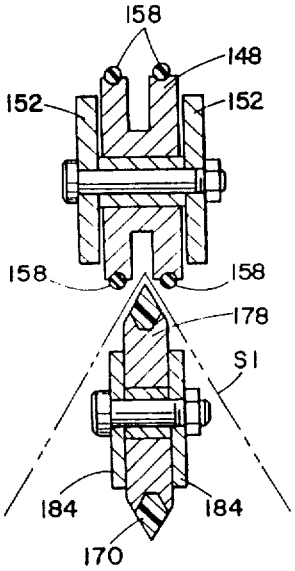
FIG. 5 is a cross-sectional view taken on line 5—5 of FIG. 4 and illustrating the relative positional relationship of the endless belts which perform the folding operation.

Positioned beneath the lower run of the spaced pair of endless belts 158 is a third endless belt member 170 which has the cross-sectional configuration best illustrated in FIGS. 3 and 5. Specifically, the belt member 170 has a generally V-shaped exterior which is adapted to extend inwardly between the lower runs of the spaced belts 158. In fact, the pulleys 150 have a V-shaped central groove 172 which is aligned with the center of the plane movement of the belt 170. As can be appreciated, as the individual scored sheets pass from the scoring roller to the position between the belt members 158 and 170, they are further bent downwardly as illustrated in FIGS. 3 and 5. Additionally, to facilitate the bend there are pairs of outwardly extending arm members 174 which can be positioned to apply further bending forces to the exterior of the individual paper sheets. These members 174 will subsequently be described in some detail. For the present, however and referring to the belt member 170, it will be noted that the belt is trained to travel along a path with its upper run cooperating as described with the lower runs of the pair of belts 158. In the subject embodiment, the belt 170 is carried by a roller and pulley assembly comprising a pair of longitudinally spaced end rollers 176 and 178 and a plurality of small pulley members 180 which are positioned to support the upper run of the belt 170. As best seen in FIGS. 1, 3 and 5, the rollers are supported between a pair of spaced support plates 184. The support plates 184 are adjustable laterally and separately supported from a pair of transversely extending shaft members 186 best seen in FIG. 1. Note that suitable brackets 188 are joined to the side of the individual plates 184 and received on the shafts 186. Suitable clamp screws are arranged to allow the brackets 188 to be clampingly engaged with the shaft 186 so as to permit lateral adjustment of the plates 184 on the shaft to align and adjust the belt 170 with the upper belts 158.

Referring again to the arm members 174 it will be noted that two of the arm members are positioned on each side of the folder assembly 18 and are carried from the previously mentioned shafts 154. Broadly, each of the arm assemblies includes a bracket member 190 which is adjustably clamped to the shaft 154 by a clamp plate bolt arrangement 192. Extending from the lower end of the clamp plate 190 is a resilient wire finger member 194 which can be positioned both laterally and vertically so that it engages the upper surface of the paper sheets passing between the belts 158 and 170. By selectively positioning the arm members 194 the downward force acting on the sheet members can be adjusted and their spacing changed to cause a progressive folding of the sheets as they pass through the folder assembly.

Figure 4:
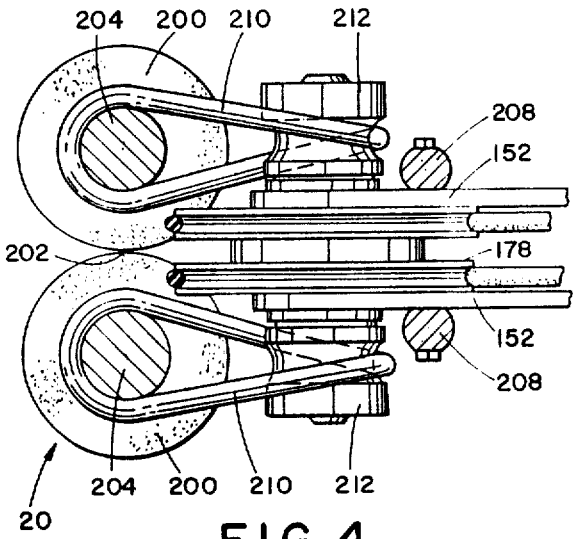
FIG. 4 is a cross-sectional view taken on line 4—4 of FIG. 1 and showing in detail the overall arrangement and construction of the pinch roll assembly which receives the sheet stock as it leaves the folder unit.

To complete the fold and to bring the sheet members to their final folded configuration prior to being dropped onto the subjacent gathering chain not shown, the unit preferably includes a pair of pinched rolls 20 shown in FIG. 1 and in the cross-sectional view of FIG. 4. Specifically, the pinch roll assembly 20 comprises a pair of rolls 200 which are positioned with their axes extending parallel and vertical and their nip 202 in alignment with the plane in which the belt 170 travels. This can be readily seen in FIG. 4. More particularly, the rolls 200 include vertical support shafts 204 which are carried from a horizontally extending frame or support unit 206. Member 206 is, in turn, carried from vertically extending shafts or bars 208 connected as to the sides of the plates 152 as best illustrated in FIG. 4. The rolls 200 are driven in timed relationship with the belts 152, 170 by being drivingly connected through a pair of drive belts 210 which are driven from drive rollers 212 carried at the outer ends of the shafts which carry the left or outer end pulley member 178.

The invention has been described with reference to preferred and alternate embodiments. Obviously, modifications and alterations will occur to others upon the reading and understanding of this specification. It is intended to include all such modifications and alterations insofar as they come within the scope of the appended claims or the equivalents thereof.

What is claimed is:

1. A feeder-folder unit for use in folding paper sheet stock and delivering it to a signature gathering machine comprising:

a main frame;

a hopper means carried by said main frame for receiving and storing a supply of sheets of paper stock with the individual sheets of paper stock positioned in vertical side-by-side relationship;

a sheet extractor and transfer drum means located adjacent said hopper means for extracting individual sheets of paper stock form said hopper means and conveying the extracted sheets along a path;

scoring and folding means located adjacent said path for receiving said sheets conveyed there along;

said hopper means including at least a pair of spaced parallel plate members mounted for independent pivotal movement about an axis extending perpendicular to said plate members and defining support surfaces for supporting said supply of sheets of stock and intermittently actuated means including continuous conveyors running parallel to said plate members and having an upper run adjacent said support surfaces for driving said sheets along said support surfaces toward said sheet extractor and transfer drum means; and separate adjustment means provided for each parallel plate member for independently varying the angular position of each said plate member to thereby vary the angular position of said support surfaces independently of each other to selectively vary the angular presentation of said sheets to said sheet extractor and transfer drum means.

2. The feeder-fold unit of claim 1 wherein said continuous conveyors of said intermittently actuated means comprise a pair of chain units located adjacent said support surfaces.

3. The feeder-folder unit of claim 1 wherein said intermittently actuated means is carried on a support frame and said parallel plate members are pivotally connected to said support frame.

4. The feeder-folder unit of claim 1 wherein said intermittently actuated means and said plate members are mounted to extend slightly downwardly toward said sheet extractor and transfer drum means.

5. The feeder-folder unit of claim 1 wherein said sheet extractor and transfer drum means includes a vacuum cup assembly mounted adjacent said hopper means.

6. A feeder-folder apparatus for folding rectangular pieces of sheet stock into a V-shaped configuration comprising:

conveyor means for moving pieces of sheet stock along a path;

scoring roll means located on said path for scoring said sheet stock along an intended fold line as said sheet stock passes therethrough; and, folding means located along said path downstream in the direction of stock movement for receiving said sheet stock from said scoring roll means and folding said sheet stock in a scored condition into a V-shape, said folding means comprising first and second endless belts of circular cross-section mounted on a first side of the path in closely spaced parallel relationship, a third endless belt means mounted on a second side of said path opposite said first and second belts, said third endless belt means having an outwardly facing V-shape and positioned to extend inwardly between said first and second belts whereby sheet stock passing along said path is folded over said third endless belt by said first and second endless belts.

7. A feeder-folder apparatus as defined in claim 6 wherein said endless belts are simultaneously driven in the same direction.

8. A feeder-folder apparatus as defined in claim 6 including a pair of pinch rolls positioned adjacent said path and adapted to receive sheet stock exiting from said folding means.

9. A feeder-folder apparatus as defined in claim 6 wherein said first and second endless belts are constrained to travel in a straight line adjacent said path by a plurality of closely spaced guide rollers.

* * * * *

UNITED STATES PATENT AND TRADEMARK OFFICE

CERTIFICATE OF CORRECTION

PATENT NO. : 5,031,889

DATED : July 16, 1991

INVENTOR(S) : John W. Raker

It is certified that error appears in the above-identified patent and that said Letters Patent is hereby corrected as shown below:

The title page should be deleted to appear as per attached title page.

The sheets of drawings consisting of Figs 1-8, should be added as shown on the attached sheets.

Signed and Sealed this

Third Day of December, 1991

*Attest:*

HARRY F. MANBECK, JR.

*Attesting Officer*

*Commissioner of Patents and Trademarks*

United States Patent [19]

Raker et al.

[11] Patent Number: 5,031,889

[45] Date of Patent: Jul. 16, 1991

[54] FOLDER AND FEEDER APPARATUS

[75] Inventors: John W. Raker, Cleveland; Keith S. Macey, Rocky River; Victor A. Zugel, Parma, all of Ohio

[73] Assignee: K. S. Macey Machine Company, Inc., Cleveland, Ohio

[21] Appl. No.: 339,810

[22] Filed: Apr. 18, 1989

[51] Int. Cl.[5] ..... B42C 1/00

[52] U.S. Cl. ..... 270/45; 271/31.1; 493/423; 493/441

[58] Field of Search ..... 270/32, 45, 54; 271/11, 271/12, 90, 30.1, 31.1; 493/405, 416, 423, 436, 441

[56] References Cited

U.S. PATENT DOCUMENTS

| | | | |
|---|---|---|---|
| 3,438,622 | 4/1969 | Laschewski | 270/45 |
| 4,588,180 | 5/1986 | Balleshazzi | 271/31.1 |
| 4,747,817 | 5/1988 | Newsome | 270/55 |
| 4,822,234 | 4/1989 | Johnson | 271/31.1 |
| 4,867,432 | 9/1989 | Matta | 271/31.1 |

*Primary Examiner*—Edward K. Look

*Assistant Examiner*—Therese M. Newholm

*Attorney, Agent, or Firm*—Fay, Sharpe, Beall, Fagan, Minnich & McKee

[57] ABSTRACT

A feeder-folder unit for use in folding paper sheet stock and delivering it to a signature gathering machine comprises a main frame with a hopper assembly carried by the main frame for receiving and storing a supply of sheets of paper stock. A sheet extractor and transfer drum assembly is located adjacent the hopper for extracting individual sheets of paper stock from the hopper means and conveying the extracted sheets along a path to a scoring and folding unit located adjacent the path. The hopper assembly includes a pair of spaced support surfaces for supporting the sheets of stock and intermittently actuated drive chains are provided for driving the sheets along the support surfaces toward the sheet extractor and transfer drum assembly. Each of the support surfaces is adjustable independently of the other and the drive chains to selectively vary the presentation of the sheets to said sheet exterior and transfer drum assembly to thereby permit precise positioning of the sheets relative to the scoring and folding unit.

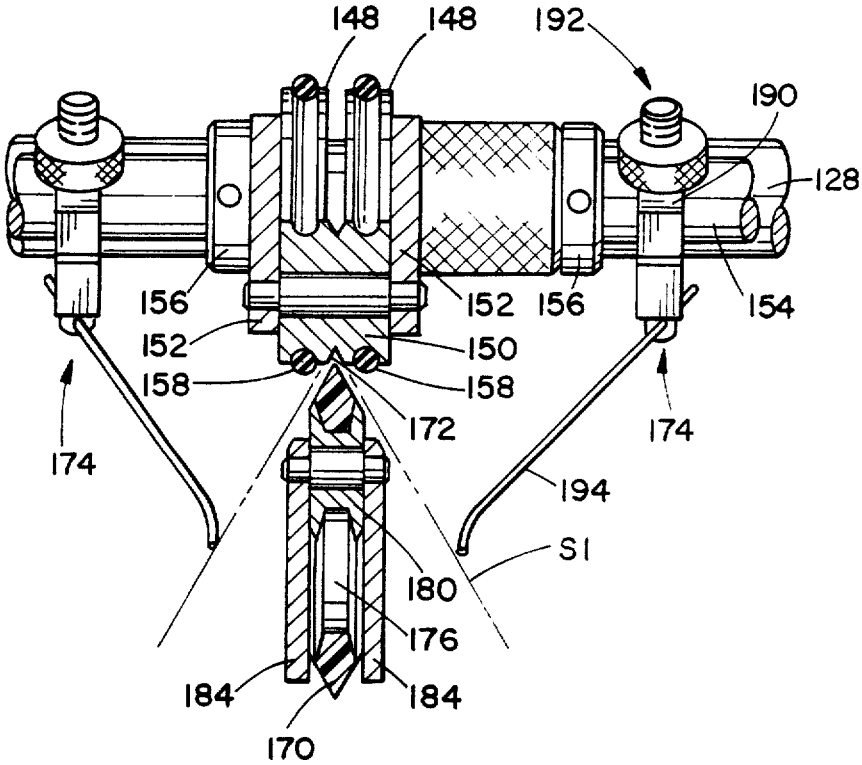

9 Claims, 4 Drawing Sheets